United States Patent [19]

Lewis et al.

[11] Patent Number: 4,516,477

[45] Date of Patent: May 14, 1985

[54] CLOSURE FOR OPENINGS IN PUMPS

[76] Inventors: Edwin C. Lewis, P.O. Box 79631, Houston, Tex. 77279; Helmut Henschenmacher, Schwarzer Weg 26, Brachelen, Fed. Rep. of Germany, D-5142; Karl-Heinz Ecker, Wilhelmstrasse 38, Erkelenz, Fed. Rep. of Germany, D-5140; Hartmut Giernalczyk, Adalbert-Stifter-Str.12; Siegfried Rutte, Gerhard-Schümmer-Str.21, both of Geilenkirchen, Fed. Rep. of Germany, D-5130

[21] Appl. No.: 535,748

[22] Filed: Sep. 26, 1983

[30] Foreign Application Priority Data

Sep. 24, 1982 [DE] Fed. Rep. of Germany ..... 3235316

[51] Int. Cl.[3] ..... F01B 29/00; F04B 21/00; F04B 39/14

[52] U.S. Cl. ..... 92/128; 417/454; 417/539; 417/559

[58] Field of Search ..... 417/454, 539, 559, 437, 417/568; 92/128, 171; 137/454.4; 411/347; 267/161, 162

[56] References Cited

U.S. PATENT DOCUMENTS

| | | | |
|---|---|---|---|
| 2,609,756 | 9/1952 | Wright et al. | 417/454 |
| 2,732,809 | 1/1956 | Mattingly et al. | 92/171 X |
| 2,786,425 | 3/1957 | Yarbrough | 92/171 X |
| 3,008,429 | 11/1961 | Stahl et al. | 92/171 X |
| 3,228,348 | 1/1966 | Wilson | 92/128 X |
| 3,245,142 | 4/1966 | Williams | 137/454.4 X |
| 3,277,837 | 10/1966 | Pangburn | 92/171 |
| 3,278,069 | 10/1966 | Pangburn | 417/454 X |
| 3,430,575 | 3/1969 | Roth | 417/437 |
| 3,610,110 | 10/1971 | Scaaf | 92/171 |
| 3,773,152 | 11/1973 | Sitton | 267/162 X |

FOREIGN PATENT DOCUMENTS

| | | | |
|---|---|---|---|
| 608880 | 9/1960 | Italy | 417/454 |

*Primary Examiner*—William L. Freeh
*Assistant Examiner*—Paul Neils
*Attorney, Agent, or Firm*—Holman & Stern

[57] ABSTRACT

Closure for openings in the housings or covers of piston pumps or the like to withstand an operating pressure which is in part an alternating load comprising an inner cover, a loadable and releasable pressure-applying member therefor, a loading device for the pressure-applying member, and for the purpose of satisfactorily meeting the requirements of practical operation without critically loading screw-threads, the loading device comprises a compression spring arranged between the pressure-applying member and a backing member, and a biassing device is provided for producing a releasing force acting in the direction opposite to that of the force of the compression spring to initially release the spring force on the pressure-applying member so that the backing member can be finally adjusted into a position to produce the desired compressive force in use.

9 Claims, 6 Drawing Figures

CLOSURE FOR OPENINGS IN PUMPS

BACKGROUND OF THE INVENTION

1. Field of the Invention

The invention relates to a closure for an opening in the housing or cover of a piston pump or the like, in particular a high-pressure fluid pump, and especially a closure for a valve housing, the closure having an insertable inner cover, a loadable and relaxable pressure-applying member for the said cover, a supporting cover which can be screwed into a threaded portion of a housing or cover part, and a loading device for the pressure-applying member.

2. Description of the Prior Art

In a known closure of this kind (German Patent Specification No. 10 72 031 corresponding to British Patent Specification No. 775314), a piston is provided in the supporting cover to form a pressure-applying member, and this piston can be loaded by a hydraulic pressure medium at the end that faces away from the inner cover. After the required final pressure is reached, a pressure screw in the supporting cover is screwed against the upper end of the piston so that this can also be held pressed against the inner cover when the pressure medium is relaxed.

Because of the purposes for which they are intended, the openings that have to be closed off in housing parts or in the cover of a piston or plunger pump are often of considerable size. They must, for example, permit a valve to be changed. At the same time the closure must be capable of withstanding the operating pressure, which, in some instances, is an alternating load. In the case of closure comprising screwed-together parts, there arises the danger of the screwed connections loosening in the course of time during operations. If the connection is not retightened in time, the threads may become flattened and the destruction of individual components may even occur.

BRIEF SUMMARY OF THE INVENTION

The object of the invention is to provide a closure for openings in pump housings that efficiently meets the requirements occurring in practice. In particular, the closure is intended to be so designed that the necessary closing force is always present and is maintained even when alternating internal pressures persist, without this being dependent upon a particular condition of a screw-threaded connection in the case of a mechanical pressure-resisting element and its bracing means. Further problems that arise in this connection and with which the invention is concerned will be seen from the description of the indicated means for solving them.

According to the invention, the loading device comprises a compression spring arranged between the pressure-applying member and a backing member, and a stress-relief device for producing a release force, opposing the force of the compression spring, is provided.

With such a closure, the closing force is applied by the compression spring and, in fact, as a prestressing force and in such manner that so-called setting losses, e.g. slight displacements, during operations, of the elements involved, yielding of sealing members, etc., are compensated by a corresponding extension of the compression spring without the closing force falling below a required value. The compression spring can be readily so rated and fitted that a minimum prestressing force is always ensured. Leaks in the zone of the sealing elements are also reliably avoided in this way. The loading of parts braced against each other can be monitored so that the service-life can be extended as a result of specific force components.

If the pump construction is of the kind in which the supporting cover is not screwed directly into a housing but into an annular or plate-like cover part, for example, which in turn is connected by screw-bolts to at least one further part of a housing or pump cover, a particularly advantageous arrangement consists in the loading device for the pressure-applying member for the closure also forming the prestressing device for the said screw-bolts, which then expediently take the form of tie rods, screw-threaded tension bars, or the like bracing elements. The spring force of the loading device is selected to meet these requirements.

A pack of disc springs, in particular, may be considered for forming the compression spring. The backing member for the compression spring is expediently formed by the supporting cover itself, but it may also be an additional part.

The stress-relief device for producing a release force, opposing the force of the compression spring when the closure is being removed, can be of purely mechanical design and, in particular, can then comprise an element which engages the pressure-applying member or is rotatable relatively thereto and which is displaceable in relation to the supporting cover, i.e. can be screwed into it.

In a further embodiment, the stress-relief device comprises a piston-and-cylinder arrangement. By loading the piston with a pressure medium, the release force is applied, as will be described in detail hereinafter. The piston of the device is expediently detachably connected to the pressure-applying member by means of screw-bolts. The cylinder associated with the piston is advantageously provided in the backing member and in particular in the supporting cover.

BRIEF DESCRIPTION OF THE DRAWINGS

Further details, features and advantages of the invention will be seen from the following descriptions of forms of construction with reference to the accompanying drawings, wherein.

DETAILED DESCRIPTION

Figure 1:
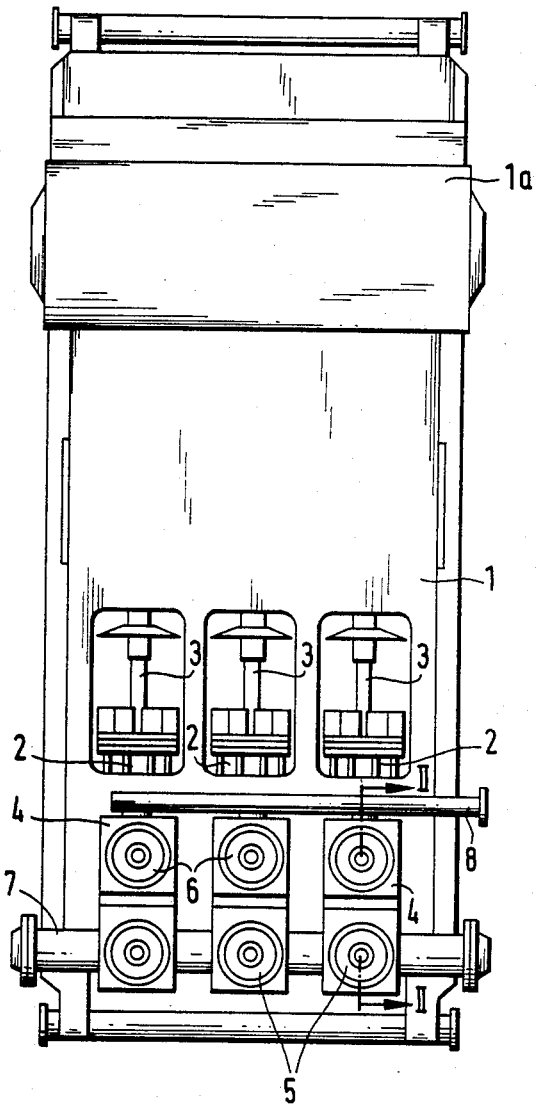
FIG. 1 is a top plan view of a triplex pump in accordance with the invention.

Closures in accordance with the invention can be advantageously used for pumps of various kinds. A single-acting triplex pump, representing a particular application, is illustrated in FIG. 1, this pump being rated for, for example, an operating pressure of 300 bars and serving as a flushing pump for drilling installations or as a pump for conveying solid substances.

There are three cylinder arrangements 2, whose pistons rods 3 derive their movements by way of connecting rods and cross-heads, from a crank drive accommodated in the rearward part 1*a* of a stand or gear frame 1. Secured to the forward end of the gear frame 1 are three pump covers 4 which are associated with the respective cylinders and which each enclose a suction valve and a compression valve. The openings for fitting the valves are closed off by covering and closure arrangements 5,6. The medium to be pumped, e.g. a bore-flushing substance, passes through a suction line 7 to the pump covers 4 and is discharged from these into a pressure line 8.

The closure 6 at the pressure side will now be described in detail with reference to FIGS. 2 to 5. A cover part 11 is connected to a pressure housing or outlet part 13, comprising the opening 12 for fitting a pressure valve (not illustrated) to a valve-accommodating part 14 and to a median part 15 of the pump cover 4, by means of tie-rods 10 with nuts 9 screwed on to them. Screwed into an internally threaded portion 21 of the cover part 11 is a supporting cover 22 which forms a cylinder 23 associated with a stepped piston 24 having an annular face. By means of a neck 25, the piston is screwed into a threaded bore 26 of a pressure-applying member 27, the parts bearing firmly against mutually facing surfaces and thus forming a single unit when in operation, but being capable of being separated for assembly purposes. The pressure-applying member 27 serves to load an inner cover 28 which, together with the seal 29, is inserted in a stepped seat which surrounds the opening 12 and is disposed at the upper end of the pressure housing 13. An attachment 30 for handling the inner cover 28 is screwed into the inner cover. A handling ring 31 is likewise screwed into the piston 24.

A compression spring in the form of a pack 33 of disc springs, located between an upper and a lower backing disc, is provided in an annular space 32 formed between the pressure-applying member 27 and the supporting cover 22.

A pressure medium, i.e. hydraulics oil, can be supplied to the cylinder 23 through a port 34 in the piston 24. Seals between the piston and the cylinder are indicated by the numerals 35 and 36.

Figures 5A, 5B:
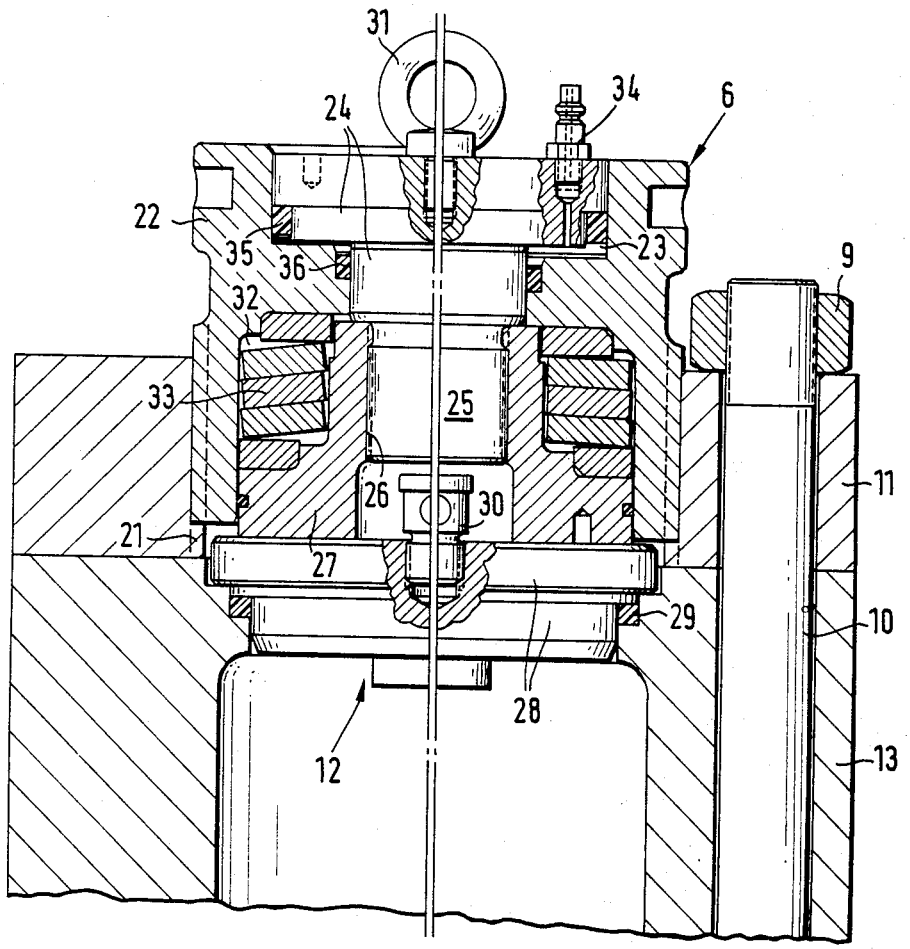
FIG. 5*a* is a cross-sectional view of a valve closure of the invention on a larger scale.
FIG. 5*b* is a view similar to FIG. 5*a* showing the valve closure in the fully inserted position.

The closure is fitted in the following manner. First, the supporting cover 22, the piston 24 with the seals 35,36 the pressure-applying member 27, and the pack 33 of disc springs are fitted together to form one unit. After insertion of the inner covering 28 with the seal 29, this unit is screwed into the internally threaded portion 21 of the cover part 11 until the pressure-applying member 27 lies on the inner cover 28. This situation is illustrated in FIG. 5*a*. Then a pressure medium, which can be provided by any suitable source and in particular by means of a hand pump, is supplied to the cylinder 23 through the port 34 so as to load the annular face of piston 24. Because of the upward movement of the piston 24, the pack 33 of disc springs is compressed by the pressure-applying member 27, which is lifted from the inner cover 28. When the required or predetermined pressure has been reached and the pack of disc springs 33 has been compressed, the supporting cover 22 together with the associated parts is screwed further into the threaded portion 21 until the pressure-applying member 27 again lies flush on the inner cover 28. The piston 24 is then relieved of load by removal of hydraulic pressure, so that the force of the pack 33 of disc springs comes into action and, by way of the pressure-applying member 27, presses the inner cover 28 firmly against its seat. This is shown in FIG. 5*b*. A tight closure is thus achieved. Release takes place, of course, in the converse manner.

Figure 2:
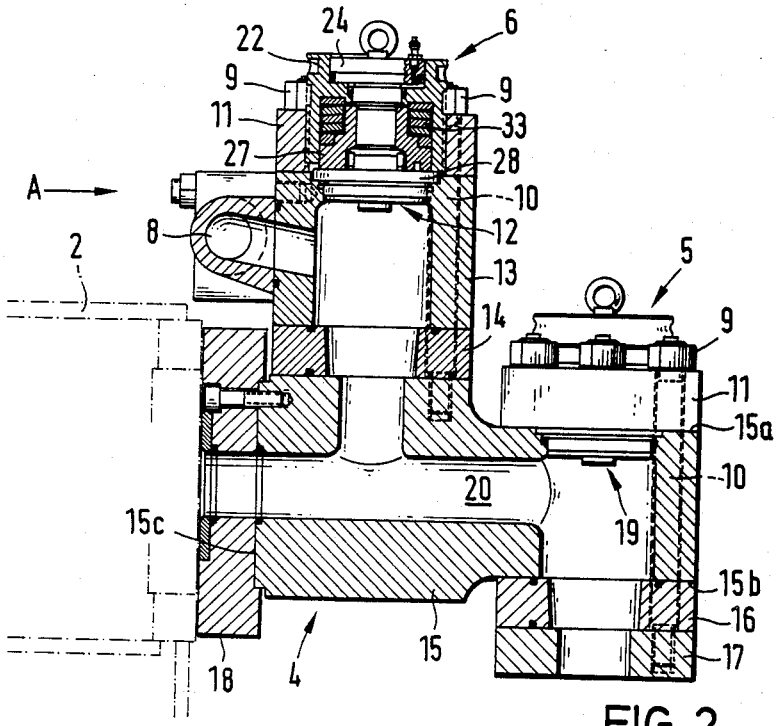
FIG. 2 is a cross-sectional view taken along the line II—II of FIG. 1, showing a pump cover.
Figure 3:
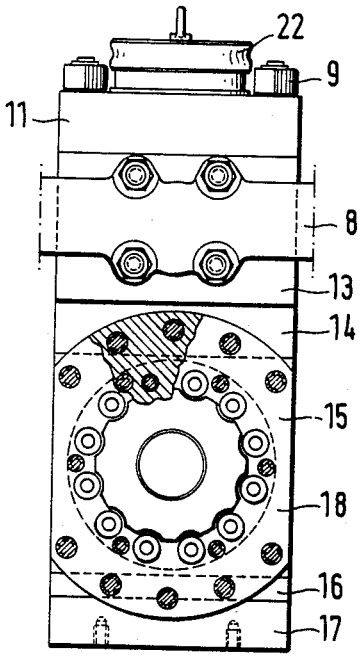
FIG. 3 is a side elevational view of the pump cover as seen in the direction indicated by the arrow A in FIG. 2.
Figure 4:
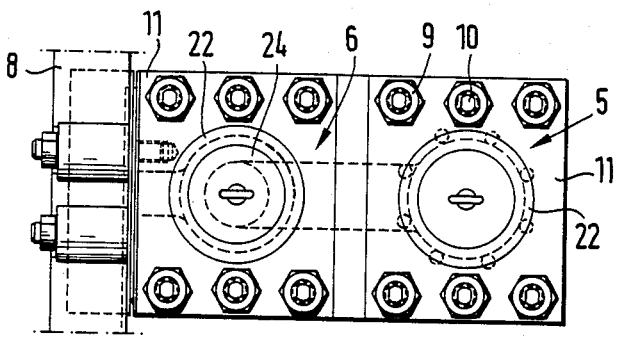
FIG. 4 is a top plan view of the pump cover.

The stress of the spring pack 33 can be so selected that, in the arrangement shown, the tie-rods 10 at the same time acquire the desired prestress, which ensures that the parts 11,13,14,15, interconnected by said tie-rods, are always held firmly and closely together. This also applies as regards other forms of housings or pump covers made up of several parts, and therefore as regards the arrangement provided at the suction side of the pump cover as shown in FIG. 2, wherein, by means of tie-rods 10, a cover part 11, closing the opening 19 and mounted on a bearing surface 15*a* of the median part, can be firmly clamped upwardly against the median part, and a suction-valve accommodating part 16, bearing against a lower surface 15*b* of the median part 15, as well as an inlet part 17, can be firmly and downwardly braced against the median part. The closure 5 is designed in the same way as the closure 6 of the pressure side, and a different rating of the compression spring can be selected, if required.

An adaptor 18, which lies against an end face 15*c* of the median part 15 and which is secured to the median part by screw-bolts, serves for connecting to a cylinder arrangement 2. The flow-path formed in the median part 15 for the medium to be conveyed carries the numeral 20.

As far as permitted by the known prior art, all of the features mentioned in the foregoing description or illustrated in the drawings are regarded as falling within the invention either singly or in combinations.

We claim:

1. In a removable closure for an opening in a pump housing or cover part including a supporting cover threadedly engageable with the housing or cover part over the opening, an inner cover member insertable between the supporting cover and opening to close the opening, a loadable and releasable pressure-applying member between the supporting cover and inner cover for applying closing pressure to the inner cover, and a device for loading the pressure-applying member, the improvement comprising:

a compression spring operatively interposed between the supporting cover and pressure-applying member to urge the pressure-applying member toward the inner cover; and means to releasably urge said pressure-applying member away from said inner cover member against the force of and to compress said compression spring:

so that the supporting cover is initially adjustable inwardly toward the opening to an initial closing position with respect to the inner cover member, said means to releasably urge the pressure-applying member away from the inner cover member is thereafter operable thereby moving the pressure-applying member away from the cover member, and the supporting cover is again adjustable inwardly to a final closing position, whereafter said means is operable to release the pressure-applying member to allow said compression spring to urge the inner cover member with a final closing force.

2. The closure of claim 1 wherein said means to releasably urge said pressure-applying member comprises a mechanical device.

3. The closure as recited in claim 1 and further comprising:

a backing member between said compression spring and the supporting cover.

4. The closure of claim 1 wherein said compression spring serves at the same time as a biassing means for bracing elements which connect a part accommodating the supporting cover to at least one further part of a pump housing or cover.

5. A closure as claimed in claim 1 wherein:

the threaded engagement between the supporting cover and housing or cover part comprises an internal screw thread in a bore of the housing or cover part and an external cooperating screw thread on the supporting cover;

the supporting cover has an inner bore in the inner end thereof adjacent the inner cover, an outer cylinder adjacent the outer end thereof, and a cylinder bore extending between and having a smaller diameter than said cylinder and inner bore, a piston operatively mounted in said outer cylinder and cylinder bore having a shape to provide an annular chamber between the inner face of said piston and said outer cylinder, and conduit means to conduct pressure fluid to said annular chamber to move said piston outwardly with respect to the inner cover;

the pressure-applying member comprises a hollow cylindrical member slidably supported within said inner bore of the supporting cover and having a reduced outer diameter portion at the outer end thereof remote from the inner cover to provide an annular opening between the pressure-applying member and the supporting cover;

said compression spring is mounted within said annular opening; and said piston is removably connected to said pressure-applying member, so that pressure fluid fed through said conduit means to said annular chamber moves said piston and pressure-applying member connected thereto away from the inner cover to compress said compression spring and provide clearance between the inner cover and pressure-applying member to allow inward movement of the supporting cover.

6. In a removable closure for an opening in a pump housing or cover part including a supporting cover threadedly engageable with the housing or cover part over the opening, an inner cover member insertable between the supporting cover and opening to close the opening, a loadable and releasable pressure-applying member between the supporting cover and inner cover for applying closing pressure to the inner cover, and a device for loading the pressure-applying member, the improvement comprising:

a pack of disc springs operatively interposed between the supporting cover and pressure-applying member to urge the pressure-applying member toward the inner cover;

a backing member between said disc spring pack and the supporting cover; and means to releasably urge said pressure-applying member away from said inner cover member against the force of and to compress said disc spring pack:

so that the supporting cover is initially adjustable inwardly toward the opening to an initial closing position with respect to the inner cover member, said means to releasably urge the pressure-applying member away from the inner cover member is thereafter operable thereby moving the pressure-applying member away from the cover member against the force of and to compress said disc spring pack, and the supporting cover member is again adjustable inwardly to a final closing position, whereafter said means is operable to release the pressure-applying member to allow said compressed disc spring to urge the inner cover member with a final closing force.

7. In a removable closure for an opening in a pump housing or cover part including a supporting cover threadedly engageable with the housing or cover part over the opening, an inner cover member insertable between the supporting cover and opening to close the opening, a loadable and releasable pressure-applying member between the supporting cover and inner cover, and a device for loading the pressure-applying member, the improvement comprising:

a compression spring operatively interposed between the supporting cover and pressure-applying member to urge the pressure-applying member toward the inner cover and away from a backing member between said compression spring and the supporting cover; and a piston-and-cylinder arrangement operatively connected to the pressure-applying member operable to releasably urge said pressure-applying member away from said inner cover member against the force of and to compress said compression spring;

so that the supporting cover is initially adjustable inwardly toward the opening to an initial closing position with respect to the inner cover member, said piston-and-cylinder arrangement thereafter being operable to move the pressure-applying member away from the cover member against the force of and to compress said spring, and the supporting cover member is again adjustable to a final closing position, whereafter said means is operable to release the pressure-applying member to allow said compressed spring to urge the inner cover member with a final closing force.

8. The closure of claim 7 wherein the piston of the piston-and-cylinder arrangement is releasably connected to the pressure-applying member.

9. The closure of claim 7 wherein the cylinder of the piston-and-cylinder device is formed in the supporting cover.

* * * * *